US011142427B2

(12) United States Patent
Christe

(10) Patent No.: US 11,142,427 B2
(45) Date of Patent: Oct. 12, 2021

(54) WINDING DEVICE WITH SUPPORT ROLLER AND CONTACT-FORCE CONTROL DEVICE AS WELL AS YARN PROCESSING MACHINE

(71) Applicant: SSM Schärer Schweiter Mettler AG, Horgen (CH)

(72) Inventor: Marcel Christe, Rüti (CH)

(73) Assignee: SSM Schärer Schwerter Mettler AG, Horgen (CH)

( * ) Notice: Subject to any disclaimer, the term of this patent is extended or adjusted under 35 U.S.C. 154(b) by 95 days.

(21) Appl. No.: 16/628,284

(22) PCT Filed: Jun. 25, 2018

(86) PCT No.: PCT/EP2018/066907
§ 371 (c)(1),
(2) Date: Jan. 3, 2020

(87) PCT Pub. No.: WO2019/007729
PCT Pub. Date: Jan. 10, 2019

(65) Prior Publication Data

US 2020/0156898 A1 May 21, 2020

(30) Foreign Application Priority Data

Jul. 5, 2017 (DE) ..... 10 2017 211 467.3

(51) Int. Cl.

| | |
|---|---|
| ***B65H 54/52*** | (2006.01) |
| ***B65H 54/553*** | (2006.01) |
| ***B65H 54/74*** | (2006.01) |
| ***B65H 63/08*** | (2006.01) |

(52) U.S. Cl.
CPC ..... *B65H 54/52* (2013.01); *B65H 54/553* (2013.01); *B65H 54/74* (2013.01); *B65H 63/084* (2013.01); *B65H 2515/34* (2013.01); *B65H 2601/524* (2013.01); *B65H 2701/31* (2013.01)

(58) Field of Classification Search
CPC ..... B65H 54/52; B65H 54/553; B65H 54/74; B65H 63/084; B65H 2515/34; B65H 2601/524; B65H 2701/31
See application file for complete search history.

(56) References Cited

FOREIGN PATENT DOCUMENTS

| | | | | |
|---|---|---|---|---|
| DE | 3002035 A1 * | 7/1980 | ..... | B65H 54/52 |
| DE | 102006042906 A1 * | 3/2008 | ..... | B65H 54/52 |
| EP | 0351672 A1 * | 1/1990 | ..... | B65H 54/52 |

* cited by examiner

*Primary Examiner* — William E Dondero
(74) *Attorney, Agent, or Firm* — Dority & Manning, P.A.

(57) ABSTRACT

A winding device for winding a yarn onto a package tube has a spindle that holds and rotationally drives the package tube. A support roller abuts against a peripheral surface of the yarn winding package during winding of the yarn. The spindle is supported by a pivotably mounted swivel arm so as to swivel relative to the support roller. A contact-force control device is provided and includes an actuator disposed to actuate the swivel arm, and a control device configured with the actuator. A bending beam load cell is configured on the swivel arm to determine an actual value of a contact force between the yarn package and the support roller. The contact force is regulated to a predetermined target value via control of the actuator by the control device.

13 Claims, 6 Drawing Sheets

WINDING DEVICE WITH SUPPORT ROLLER AND CONTACT-FORCE CONTROL DEVICE AS WELL AS YARN PROCESSING MACHINE

FIELD OF THE INVENTION

The invention relates to a winding device with support roller and contact-force control device, as well as to a yarn processing machine that incorporates the winding device.

BACKGROUND

In practice, threads, textile yarns, fibers, and the like, made of natural or synthetic materials, which are referred to hereinafter as yarns, are wound for further processing, particularly including for dyeing processes, onto so-called package tubes to form a yarn package, which is also referred to as a yarn winding package. This can be done by means of cross winding, for example. Winding devices with a spindle for rotatably supporting the package tube are used for this purpose. The spindle can be driven rotationally by means of a spindle drive. A support roller generally rests against the peripheral surface of the yarn winding package during winding. The spindle drive can be designed according to a known type in the form of a friction roller drive, in which the motor-driven support roller serves as a friction roller and drives the spindle. The support roller can be configured as required in the form of a grooved drum. According to another type, the support roller is in rolling contact with the package tube or the yarn package to be produced thereon and is carried along by the rotationally driven spindle. The yarn traveling to the yarn winding package is fed to the package tube or yarn winding package in the vicinity of the contact of the support roller and the yarn winding package, whereby undesired thrust forces on the yarn and inadequate yarn tension can be avoided during the winding process. According to one design, the spindle is supported on the machine frame by means of a creel with at least one pivotably mounted swivel arm so as to be movable relative to the support roller.

It is known that, particularly for dyeing processes, the yarn winding package produced on the package tube must have a high degree of uniformity in order to enable the entire yarn winding package to be dyed uniformly. The uniformity of the yarn winding package depends to a critical extent on a uniform yarn tension, the winding pattern (winding angle) of the yarn on the package tube, and uniform contact pressure between the yarn winding package and the support roller. Winding devices have long been available on the market in which the contact force by which the support roller and the yarn winding package are pressed against one another is controlled or regulated. The support roller and the spindle can be biased against one another, for example by means of a compression or tension spring. In general, additional damping of the winding device is required here. However, this often varies so much that the contact force is de facto only insufficiently adjustable.

When the contact force is regulated by means of a pneumatic cylinder, the contact force varies at least due to the unavoidable friction (stick-slip behavior) of the piston seals used there. What is more, a compressed-air system must be provided for the winding device, which entails corresponding cost disadvantages.

If the contact force is regulated by means of an electric gear motor, this is usually performed on the basis of the metrologically detected motor current. However, frictions in the gearbox and temperature changes in the motor often lead to errors here. Gearboxes with spur gears or toothed belts usually have too much play or are too elastic, for which reason they are rather unsuitable for precise control of the contact force.

SUMMARY OF THE INVENTION

It is an object of the invention to provide a winding device and a yarn processing machine with a winding device for winding a yarn on a package tube by which a contact force between the support roller and a yarn winding package formed on the package tube that is adapted to the winding process can be achieved in a cost-effective and precise manner. Additional objects and advantages of the invention will be set forth in part in the following description, or may be obvious from the description, or may be learned through practice of the invention.

The objects relating to the winding device are achieved by a winding device as set forth and claimed herein.

In an embodiment of the winding device according to the invention, the spindle for holding and rotatably driving the package tube to be wound with the yarn can be swiveled relative to the support roller by means of at least one pivotably mounted swivel arm. The winding device has a contact-force control device. The contact-force control device comprises an actuator for actuating (swiveling) the swivel arm. A control device is used to control the actuator. In other words, the swivel arm and the spindle arranged thereon can be swiveled in a controlled manner relative to the support roller by means of the actuator. According to the invention, the contact-force control device has a bending beam load cell that is associated with the swivel arm. The bending beam load cell is used to determine a respective actual value of the contact force with which the yarn package and the support roller are pressed together in the winding operation, it being possible for the contact force to be regulated to a predetermined target value by means of the control device on the basis of the actual value of the contact force through appropriate controlling of the actuator.

Bending beam load cells have a metallic spring body that is elastically deformed under load. The positive or negative strain is converted into an electrical signal by a strain gauge that is adhered to the spring body. The signal is fundamentally dependent on the bending moment. If the load application point in the longitudinal direction of the bending beam changes under the same load, different signals are of course produced. It will readily be understood that the load application point on the load cell must therefore be kept constant. Ready-made bending beam load cells for the measuring ranges that are relevant to winding devices are available on the market at low cost. Installation thereof on an exposed and readily accessible location on the swivel arm of the creel is conceivably easy. For example, the load cell can be screwed securely to the swivel arm by means of appropriate screws. The bending beam load cell is advantageously fastened to an upper-side mounting surface—i.e., to a side of the swivel arm that points upward in the vertical direction during operation. In this way, only the resulting forces that are directed orthogonally to the mounting surfaces (and the functional measuring plane of the load cell arranged in parallel thereto) are detected by the load cell. Undesired shearing and torsional forces such as those which can act on the swivel arm during winding operation are therefore ignored metrologically.

In addition, the aforementioned load cells are available on the market with a sufficiently high sampling rate. Through appropriate evaluation of the measurement signals received from the bending beam load cell, disturbance variables such as undesired component oscillations of the winding device, for example, can be identified with greater ease and appropriately taken into account in the controlling of the winding device, particularly of the respective rotational speed of the spindle/package tube—i.e., the yarn speed resulting therefrom—during the winding process.

The inventive arrangement of the bending beam load cell on the swivel arm offers further advantages. For one, due to the sometimes large mass of the yarn winding package, the swivel arm must already have a high load-bearing capacity and, as such, have a solid and stable design. Undesired oscillations of the swivel arm that could lead to disturbances in the regulation of the contact force can thus be counteracted quite effectively without an additional increase in material costs, and hence without additional costs.

According to an especially preferred embodiment of the invention, the bending beam load cell is integrated into the swivel arm. As a result, the load cell can be protected in an especially reliable manner against undesired damage. According to the invention, the bending beam load cell preferably does not extend over the outer contour of the (remaining) swivel arm at any point in a radial direction relative to the longitudinal extension of the swivel arm. This enables the risk of injury on the part of an operator of the winding device to be minimized. What is more, a uniform visual appearance of the swivel arm can be achieved in this way.

According to an especially preferred development of the invention, the bending beam load cell is embodied as a multiple bending beam load cell. Multiple bending beam load cells are characterized by the arrangement of usually two (dual) bending beams or three (triple) bending beams. In this design, the bending beams are intercoupled by rigid components on the clamping and load introduction side. By virtue of this rigid mechanical coupling of the bending beams, the load cells are much less sensitive to shifts in the load application point than with a single bending beam. Due to the S-shaped deformation of the multiple bending beam load cells, zones of positive and negative expansion occur close together on the surfaces, which further simplifies the attachment and interconnection of the strain gauges used. This provides further-improved reliability of measurement and allows for a less malfunction-prone operation of the winding device.

According to the invention, the spindles can also be arranged so as to be swivelable relative to the support roller by means of two swivel arms. This makes it possible to ensure especially precise alignment and movement of the spindles as well as of the spindles held thereon relative to the support roller. The quality of the yarn winding package produced can be reproducibly improved even further in this way. In this case, the swivel arms only have to absorb half of the contact force. Accordingly, the swivel arms can be fabricated using less material or meet heavy duty requirements.

According to the invention, only one of the two or each of the two swivel arms can be provided with (at least) one bending beam load cell, particularly a multiple bending beam load cell as detailed above. Here, the respective load cells absorb half of the contact force or the force vector of half of the contact force that is aligned orthogonally to their measuring plane (mounting plane).

According to the invention, the actuator is preferably an electric motor. Electric motors can be obtained at low cost and in a suitable configuration on the market. The electric motor can be advantageously embodied as a stepping motor.

According to an especially preferred embodiment of the invention, the actuator is coupled with the swivel arm or with the swivel arms of the spindle by means of a planar spiral gear. This enables the actuator to be coupled with the swivel arm or the swivel arms without play or substantially without play. The contact force of the support roller at the yarn winding package can thus be adjusted and readjusted in a highly precise manner during the winding process. Even large torques can be readily transmitted by means of the planar spiral gear. With their simple constructive design, planar spiral gears are especially compact and have the high reliability and long service life that is essential for winding devices. Due to their compact design, they can also be easily retrofitted for existing winding devices. In order to ensure that the planar spiral gear has a certain degree of elasticity, at least one of the gear parts of the planar spiral gear can be made of a viscoelastic material, particularly a plastic.

In the structurally simplest case, a drive motor or spindle drive for the rotational driving of the package tube is mounted on a swivel arm of the spindle and supported together therewith so as to swivel about the swivel axis of the creel. On the one hand, the mass of the creel can thus be increased in such a way that undesired vibrations of the package tube to be wound with the yarn are counteracted during the winding process. On the other hand, the motor can be used as a balancing mass for the spindle and the package tube carrying the yarn winding package. The contact force can be easily controlled in this way.

According to the invention, the creel can be provided with an additional biasing element, particularly in the form of a spring element. The spring element can be embodied in particular as a tension or compression spring. Such spring elements with suitable parameterization are available on the market at low cost. By means of the biasing element, a backlash-free gear coupling of the actuator and the swivel arm can be achieved, which allows for high-precision control of the contact force between the support roller and the package tube/the yarn winding package.

Moreover, the creel can also be provided with a damping element in order to counteract undesired mechanical vibrations. The damping element can comprise, a piston-cylinder unit or an elastomer component, for example.

If, during the winding operation, the yarn winding package rests against the top side of the support roller in an axial direction relative to the vertical, then the package weight (i.e., the weight of the yarn wound on the package body) is preferably also taken into account during the regulation of the contact force between the support roller and the yarn winding package. In this case, the control device is set up, particularly programmed, to determine the package weight during the winding process and to control the contact force of the support roller against the yarn winding package on the basis of the respective package weight. For instance, the control device can be designed, particularly programmed, to calculate the respective package weight on the basis of measured data for a wound length of the yarn wound onto the package tube and the fineness thereof. It will readily be understood that information on the fineness of the yarn to be wound must be stored in the control device for this purpose. The winding device is preferably equipped with a corresponding measurement sensor in order to measure the respective wound length.

According to the invention, the control device can be set up, particularly programmed, to detect undesired mechanical oscillations of the spindle on the basis of measured data of the above-described bending beam load cell(s) and to counteract such mechanical oscillations by means of control technology, for example by reducing a respective rotational speed of the spindle. If the winding device also has a controllable damping element for the swivel arms carrying the spindle or spindles—i.e., a damping element whose damping characteristics are variably adjustable—then the damping element can be controlled alternatively or in addition by the control device in order to counteract the mechanical oscillations.

The yarn processing machine according to the invention has at least one above-described winding device and a traversing unit associated with the winding device by means of which the yarn to be wound on the package tube can be moved back and forth relative to the package holder in the direction of the spindle axis. The traversing unit can be embodied as an impeller traversing unit, for example, or else as a traction-based traversing unit with a yarn guide that can be moved back and forth by a traction means. Alternatively, the traversing unit can also comprise a grooved drum, which is preferably formed by the support roller.

Additional advantages of the invention follow from the description and the drawing. The embodiments that are shown and described must not be understood as an exhaustive enumeration, but rather as examples intended to portray the invention.

DETAILED DESCRIPTION

Figure 1:
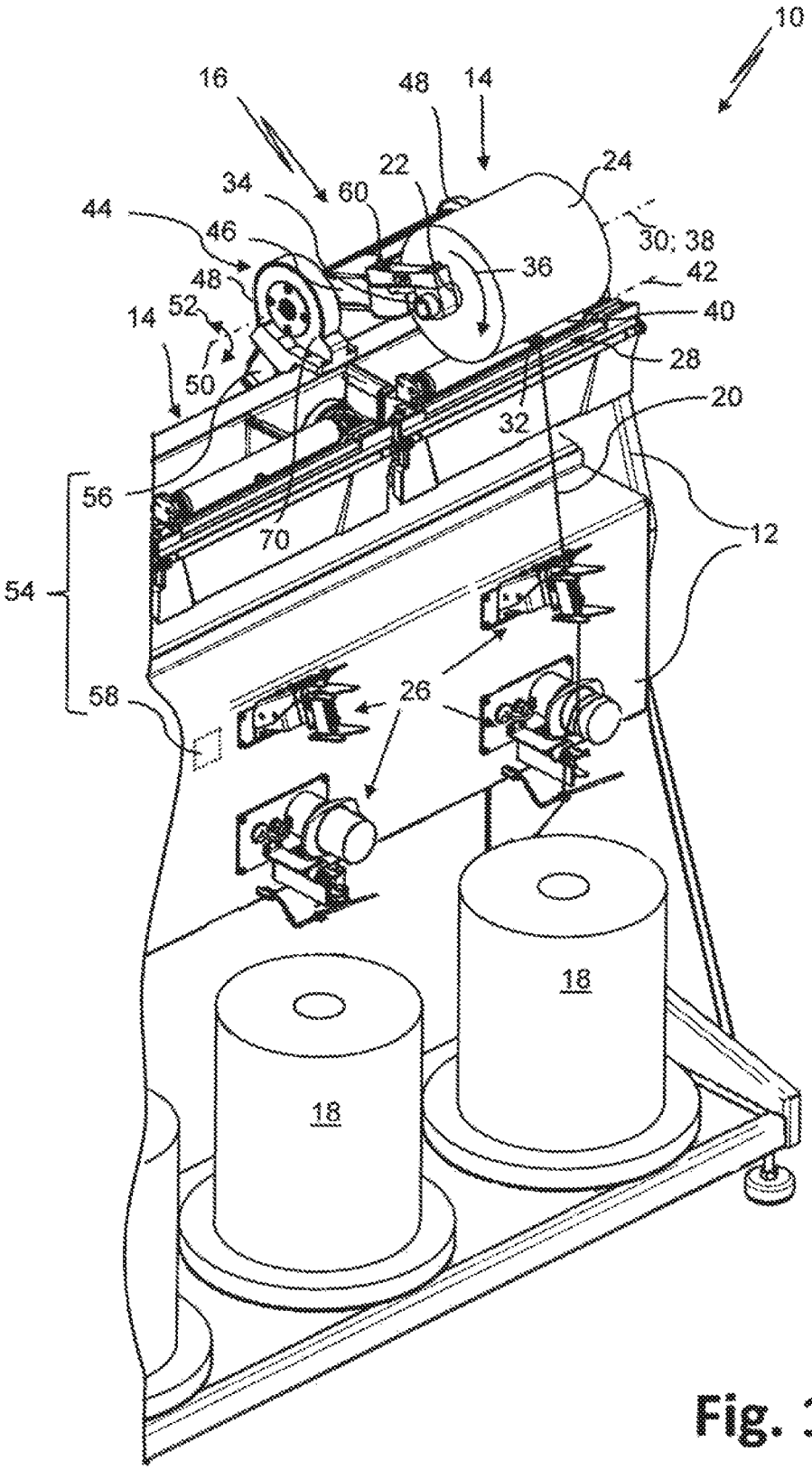
FIG. 1 shows a partial perspective view of a yarn processing machine with a plurality of winding heads for winding a yarn on a package tube, each winding head having a winding device with a pivotably mounted spindle that can be pressed by means of a contact-force controller with a predetermined contact force against a support roller.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a partial perspective view of a yarn processing machine 10. The yarn processing machine 10 has a machine frame 12 on which a plurality of winding heads 14 are arranged side by side. The winding heads 14 each have a winding device 16 for winding a yarn 20 that is provided on a supply package 18 on a package tube 22 to form a yarn winding package 24 (=wound package). The yarn 20 traveling to the package tube 22 can be fed reciprocally via a yarn-guiding mechanism 26 of a traversing unit 28 positioned on the machine frame 12 and through the traversing unit 28 in the direction of the longitudinal axis 30 of the package tube 22 relative to the package tube 22 over a fixed predetermined or variably predeterminable angular range.

Here, by way of example, the traversing unit 28 has a traction-guided yarn guide 32. According to an exemplary embodiment that is not shown in detail in the drawing, the traversing unit 28 can also be embodied as an impeller-type traversing unit 28 or comprise a so-called finger or pendulum yarn guide.

The package tube 22 to be wound with the yarn 20 is detachably mounted on a motor-driven spindle 34 and can be rotated in the direction of rotation 36 about its longitudinal axis 30. The longitudinal axis 30 of the package tube 22 coincides with the spindle longitudinal axis 38 of the spindle.

A support roller 40 whose axis of rotation 42 is arranged so as to extend parallel to the spindle longitudinal axis 38 of the spindle 34 (and hence to the longitudinal axis 30 of the package tube 22) is rotatably mounted on the machine frame 12 (in the vertical direction) below the spindle 34. According to FIG. 1, the support roller 40 rests directly against the yarn winding package 24 produced on the package tube 22. The yarn 20 is guided over a partial peripheral angle about the support roller 40 and can be placed against the lateral surface of the yarn winding package 24 in the area of contact of the support roller 40 and yarn winding package 24.

The spindle 34 is attached to the machine frame 12 by means of a creel 44. Here, the creel 44 comprises two pendulum or swivel arms 46, only one of which is shown in FIG. 1 for purposes of illustration. The swivel arms 46 can be swiveled relative to the support roller 40 about a swivel axis denoted by 50 by means of a shaft (not shown) supported on support parts 48. The yarn winding package 24 and the support roller 40 are pressed against one another by a contact force, which can be varied by means of a swiveling movement of the spindle 34 relative to the support roller 40. The winding device 16 comprises a contact-pressure control device 54 for this purpose which includes an actuator 56 for actuating the swivel arms 46. The actuator 56 may be an electric motor. A control device 58 is used to control the electric motor. The control device 58 comprises a bending beam load cell 60, here in the form of a dual bending beam load cell 60, for determining the actual value of the contact force of the yarn package 24 against the support roller 40. The spindle 34 is fixed at one end via the dual bending beam load cell 60 to one of the swivel arms 46 of the creel 44. The control device 58 can be set up, e.g., particularly programmed, to detect undesired mechanical oscillations of the spindle 34 on the basis of measured data of the bending beam load cell 60 during the winding process and to counteract such oscillations by means of control technology, for example by reducing a rotational speed of the spindle 34.

Figure 2:
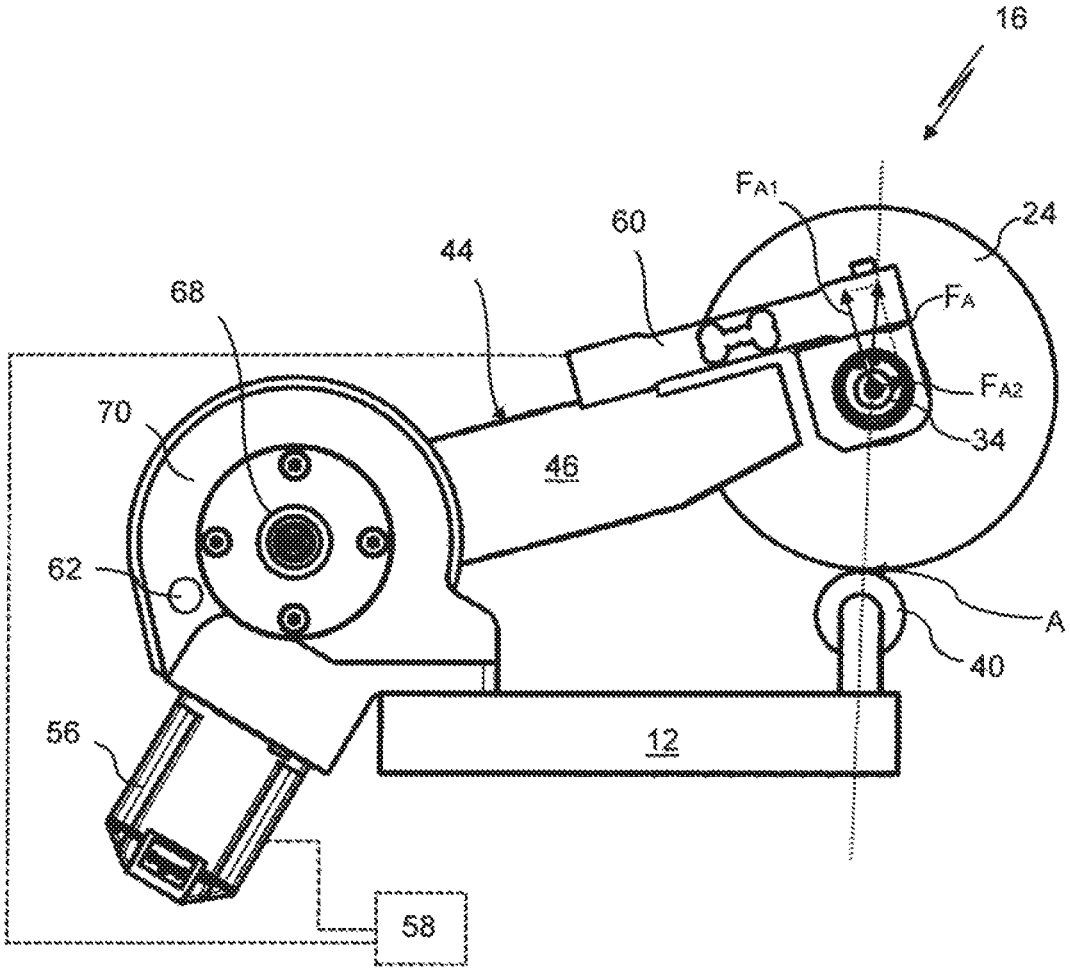
FIG. 2 shows the winding device according to FIG. 1 in a cutaway side view.

FIG. 2 shows the winding device 16 of the yarn processing machine 10 according to FIG. 1 in a partially cutaway side view. The dual bending beam load cell 60 is attached at one end to a swivel arm 46 of the creel 44 and at the other end to the rotatably driven spindle 34, secured here by a screw connection, for example.

The support roller 40 abuts against the yarn package along a contact region A. Here, due to the dual bearing of the spindle 34, only half of the contact force $F_A$ of the yarn package 24 against the support roller 40 is introduced into the two swivel arms 46 of the creel 44. The contact force $F_A$ is oriented so as to extend orthogonally to the spindle longitudinal axis 38 and the axis of rotation 42 of the pressure roller 40 in the direction of an axis denoted by 61. FIG. 2 shows the halved contact force $F_A$ with its two mutually orthogonal force vectors $F_{A1}$, $F_{A2}$. The dual bending beam load cell 60 can only absorb a force orthogonal to its mounting or measuring plane, in this case the force vector $F_{A1}$ of the halved contact force $F_A$. The control device 58 is programmed to determine the actual value of the (total) contact force $F_A$ on the basis of the respective swivel position of the spindle 34 about its swivel axis 50 relative to the support roller 40 and of the measured values obtained by the dual bending beam load cell 60 of the vector $F_{A1}$ of contact force $F_A$ directed orthogonally to the measuring or mounting plane of the bending beam load cell 60. As will readily be understood, the bending beam load cell must have a sufficiently large sampling rate for this purpose. A position sensor denoted 62 can be used to detect the respective swivel position of the spindle 34. The control device 58 actuates the electric motor 56 on the basis of the measured values obtained from the bending beam load cell in such a way that the contact force $F_A$ of the yarn winding package 24 against the support roller 40 is regulated to a respectively predetermined target value of the contact force $F_A$. This target value is stored in the control device 58, particularly in a storage means (not shown) of the control device 58, and can be variably adapted to different winding processes if required. In determining the actual value of the contact force $F_A$, the control device 58 is set up to take into account the respective weight of the package tube 22 that is wound with the yarn—i.e., the respective package weight. The package weight can be determined in a simple manner by the control device itself on the basis of the fineness of the respective yarn and the respective length of yarn on the package tube. Information on the fineness of the yarn to be wound is preferably kept (stored) in the control device 58. The respective yarn length of the yarn 20 that has already been wound onto the package tube 22 can be determined in an inherently known manner on the control side by means of a suitable sensor arrangement (not shown), for example of the yarn-guiding mechanism 26 (FIG. 1).

Figure 3:
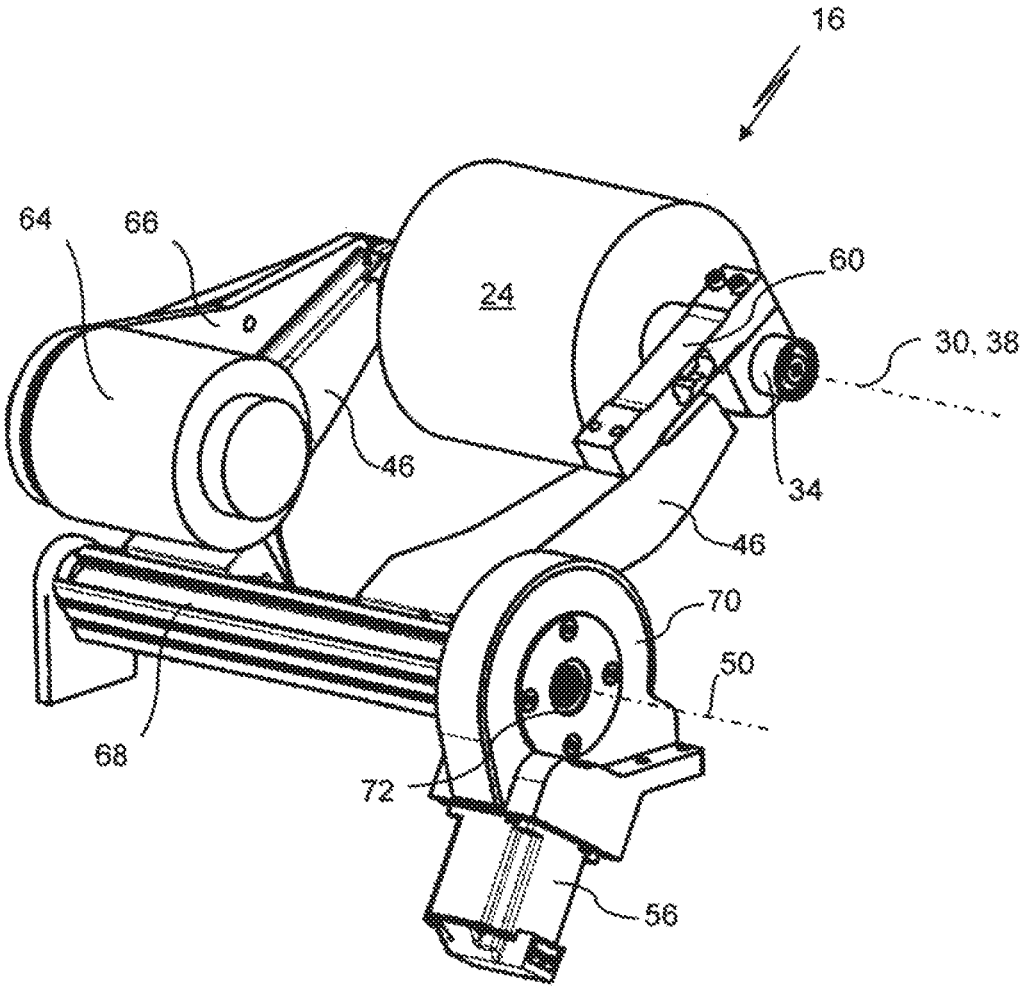
FIG. 3 shows a perspective view of a winding device in which a drive motor for the spindle is mounted on a swivel arm that carries the spindle.

FIG. 3 shows detail of another exemplary embodiment of a winding device 16. The winding device 16 differs from the exemplary embodiment shown in FIGS. 1 and 2 substantially in that a spindle drive 64 for the spindle 34 is mounted on the creel 44, more precisely on one of the swivel arms 46 of the creel 44. The spindle drive 64 can be coupled with the spindle 34 via a drive belt (not shown in FIG. 3), for example in the form of a toothed belt. It should be noted that the spindle drive 64 is fixed to the swivel arm 46 by means of a mounting element 66 in such a way that the weight force of the drive motor 64 relative to the swivel axis 50 causes a torque that is directed counter to the spindle 34 and to the package tube 22 (with yarn winding package) arranged thereon. The shaft 68 of the swivel arms 46 mentioned above in connection with FIG. 1 can be seen clearly in FIG. 3.

In the winding devices 16 shown in FIGS. 1 to 3, the actuator 56 of the swivel arms 46 is respectively coupled by means of a planar spiral gear with the rotating shaft 68 of the two swivel arms 46. In the exemplary embodiments that are shown in FIGS. 1 to 3, the planar spiral gear is partially concealed in each case by a gearbox 70. Here, the planar spiral gear has a spur gear 72 that is arranged in a torque-proof manner against rotation of the shaft 68.

Figures 4A, 4B:
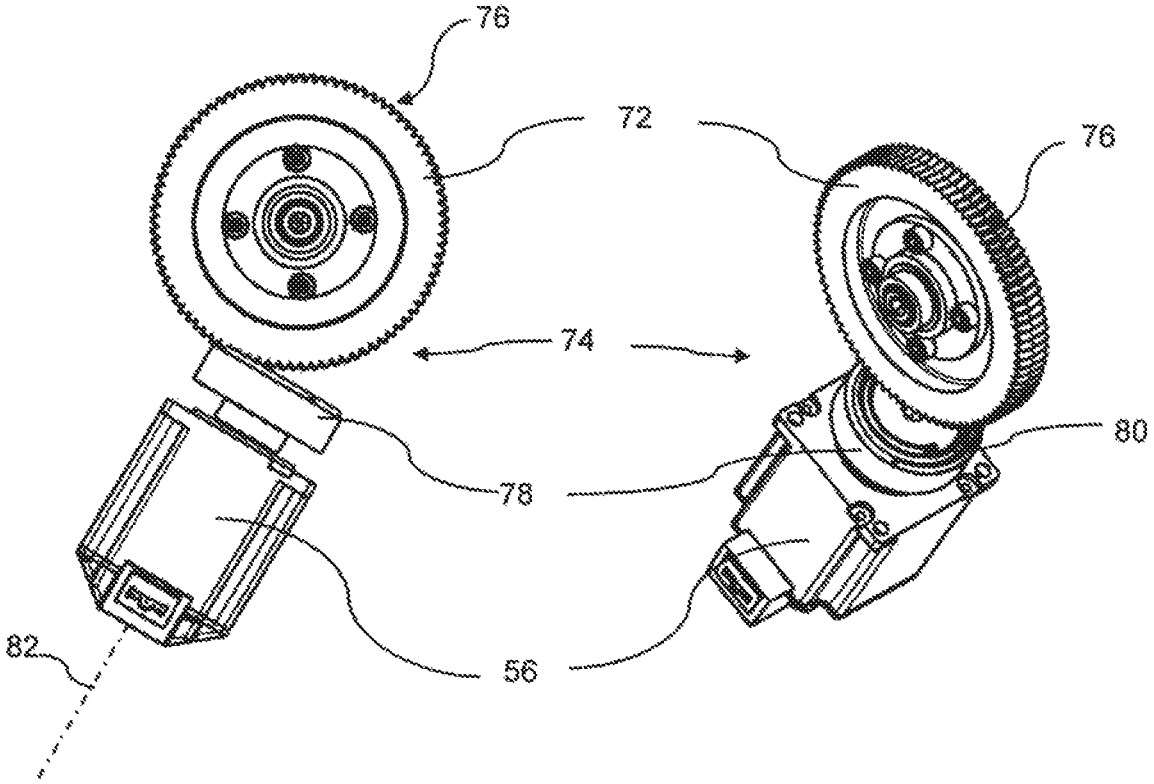
FIG. 4 shows a planar spiral gear used in the winding devices according to FIGS. 1 to 3 in a side view (FIG. 4A) and in a perspective view (FIG. 4B)

FIGS. 4A and 4B, each in a cutaway view, show the actuator 56, which is embodied as an electric motor, with the planar spiral gear 74. The spur gear 72 has a curved toothing 76 that engages in a planar spiral gear 78 with a spiral-shaped tooth profile 80. With its extremely compact design, the planar spiral gear 74 enables high translation and minimal friction losses to be achieved. As a result, it is possible to ensure a sufficiently dynamic regulation of the contact force $F_A$ (FIG. 2) for winding processes with which the support roller 40 and the yarn winding package 24 are pressed against one another. By virtue of the special toothing, the contact surface of the two gear parts is enlarged and the material stresses to which they are exposed are substantially reduced. As a result, the planar spiral gear 74 is low-maintenance and has the longevity that is desired for a yarn processing machine 10. It should be noted that the backlash of the gear mechanism can be adjusted through axial displacement of the planar spiral wheel 78 along its axis of rotation 82, which coincides here with the motor shaft axis (not labeled), or even eliminated altogether. An extremely precise control of the contact force $F_A$ (FIG. 2) can thus be realized. In order to impart—limited—elasticity to the planar spiral gear 74, the spur gear 72 with curved toothing can be made of a viscoelastic material, for example, particularly a plastic material. Smaller or high-frequency oscillations of the spindle 34, which cannot be avoided during the winding operation, can be absorbed harmlessly by the planar spiral gear 74.

Figure 5:
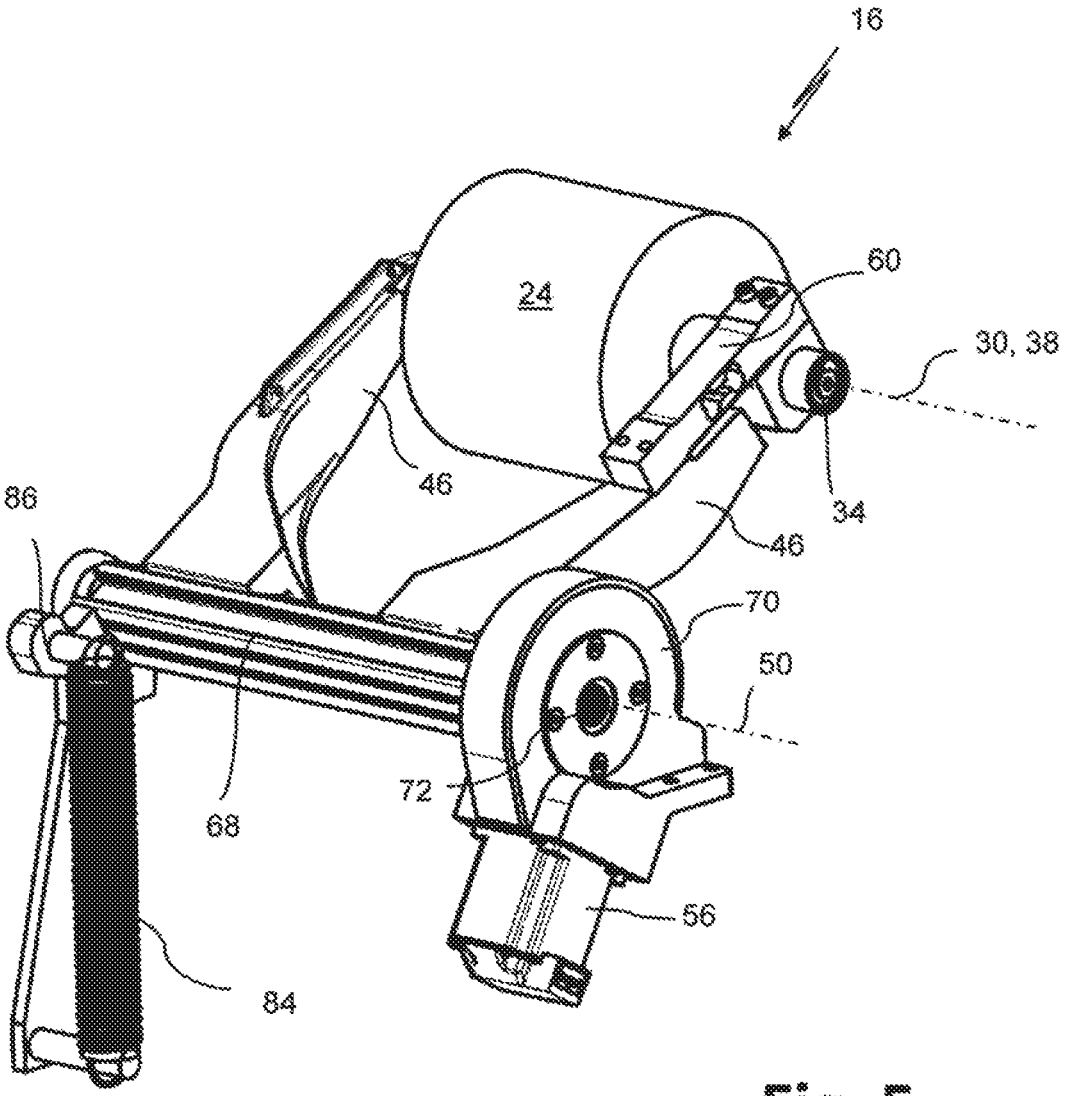
FIG. 5 shows a perspective view of a winding device with damping element for a yarn processing machine according to FIG. 1.

The winding devices 16 shown above in connection with FIGS. 1 to 3 can have an additional biasing element 84. This enables maximum clearance in to be achieved in the planar spiral gear. In the simplest of cases, the biasing element 84 can be embodied as a tension spring as shown in FIG. 5. Here, the tension spring engages at one end on a radial arm 86 of the shaft 68 and at the other end on the machine frame 12. Additionally or alternatively, the winding devices 16 can have a damping element (not shown in detail in the drawing) to counteract undesirable oscillations of the spindle 34 during the winding process. The damping element can, in particular, be variably adjustable, and it can be advantageously controlled by the control device of the winding device 16.

Figure 6:
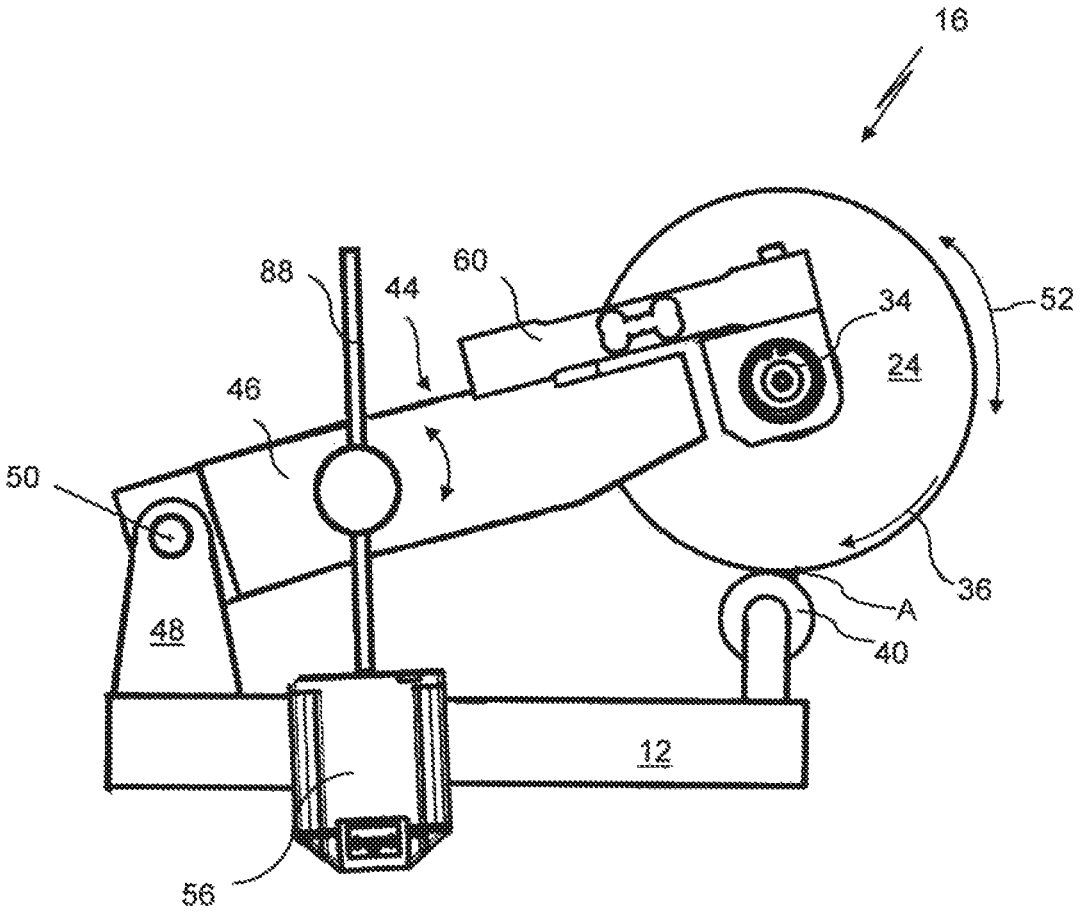
FIG. 6 shows a side view of an alternative embodiment of a winding device for a yarn processing machine according to FIG. 1.

FIG. 6 shows another exemplary embodiment of a winding device 16 such as can be used in a yarn processing machine 10 according to FIG. 1. The winding device 16 differs from the winding devices 16 that are shown above in connection with FIGS. 1 to 5 substantially in that a swivel arm 46 of the creel 44 can be actuated by means of a threaded spindle 88 that can be driven rotationally by the electric motor 56. The threaded spindle 88 engages in an unspecified threaded bore of the swivel arm 46.

In an exemplary embodiment that is not shown in further detail in the drawing, the creel 44 of the winding devices 16 can also have only one swivel arm 46. In this design, the dual bending beam load cell 60 thus absorbs the orthogonal force vector $F_{A1}$ of the total contact force $F_A$ of the support roller 40 against the yarn winding package 24.

Modifications and variations can be made to the embodiments illustrated or described herein without departing from the scope and spirit of the invention as set forth in the appended claims.

The invention claimed is:

1. A winding device for winding a yarn onto a package tube to form a yarn winding package, comprising:

a spindle configured to hold and rotationally driving the package tube about a longitudinal axis of the package tube;

a support roller configured to abut against a peripheral surface of the yarn winding package during winding of the yarn;

the spindle supported by at least one pivotably mounted swivel arm, wherein the spindle can swivel relative to the support roller;

a contact-force control device, comprising:

an actuator disposed to actuate the swivel arm;

a control device configured with the actuator;

a bending beam load cell configured on the swivel arm to determine an actual value of a contact force (FA) by which the yarn package and the support roller are pressed against one another; and wherein the contact force (FA) is regulated to a predetermined target value via control of the actuator by the control device.

2. The winding device as set forth in claim 1, wherein the bending beam load cell comprises a dual bending beam load cell.

3. The winding device as set forth in claim 1, wherein the bending beam load cell is integrated into the swivel arm so as not to extend laterally over an outer contour of the swivel arm at any point along the bending beam load cell.

4. The winding device as set forth in claim 1, wherein the spindle is supported by two of the pivotably mounted swivel arms.

5. The winding device as set forth in claim 4, wherein each of the swivel arms is configured with one of the bending beam load cells.

6. The winding device as set forth in claim 1, wherein the actuator comprises an electric motor.

7. The winding device as set forth in claim 1, wherein the actuator is coupled with the swivel arm by a planar spiral gear.

8. The winding device as set forth in claim 1, comprising a spindle drive for the spindle, the spindle drive mounted on the swivel arm so as to be swiveled therewith.

9. The winding device as set forth in claim 1, further comprising one or both of a damping element or a biasing element configured the spindle.

10. The winding device as set forth in claim 1, wherein the control device is programmed a package weight during the winding process and to account for the package weight in the regulation of the contact force FA.

11. The winding device as set forth in claim 10, the control device calculates the package weight based on measured data for a length of the yarn wound onto the package tube and a fineness of the yarn.

12. The winding device as set forth in claim 1, wherein the control device is programmed to detect undesired mechanical oscillations of the spindle based on measured data of the bending beam load cell and to counteract the oscillations.

13. A yarn processing machine, comprising at least one winding device as set forth in claim 1.

* * * * *